US010436510B2

(12) United States Patent
Rettig

(10) Patent No.: US 10,436,510 B2
(45) Date of Patent: Oct. 8, 2019

(54) AMMUNITION CARTRIDGE CASE DRYER

(71) Applicant: Gary P Rettig, Chelsea, AL (US)

(72) Inventor: Gary P Rettig, Chelsea, AL (US)

( * ) Notice: Subject to any disclaimer, the term of this patent is extended or adjusted under 35 U.S.C. 154(b) by 238 days.

(21) Appl. No.: 15/193,073

(22) Filed: Jun. 26, 2016

(65) Prior Publication Data

US 2017/0370646 A1 Dec. 28, 2017

(51) Int. Cl.

| | |
|---|---|
| ***F26B 9/00*** | (2006.01) |
| ***F42B 33/10*** | (2006.01) |
| ***F26B 3/02*** | (2006.01) |
| ***F26B 9/10*** | (2006.01) |
| ***F26B 21/00*** | (2006.01) |

(52) U.S. Cl.

CPC ..... *F26B 9/003* (2013.01); *F26B 3/02* (2013.01); *F26B 9/10* (2013.01); *F26B 21/006* (2013.01); *F42B 33/10* (2013.01)

(58) Field of Classification Search

CPC ..... F26B 21/004; F26B 3/02; F26B 9/003; F26B 9/10; F42B 5/26; F42B 33/10

USPC ..... 34/104

See application file for complete search history.

(56) References Cited

U.S. PATENT DOCUMENTS

RE24,144 E * 4/1956 Dungler ..... B26F 1/28 34/656
2,797,074 A * 6/1957 Flynn ..... B41F 23/043 101/416.1
3,299,529 A * 1/1967 Roberts ..... A47L 23/20 219/400
5,469,635 A * 11/1995 Lamontagne ..... F26B 21/006 34/104
5,592,750 A * 1/1997 Eichten ..... D06F 59/02 223/70
5,862,606 A * 1/1999 Jannach ..... D06F 17/04 134/166 R
6,766,591 B1 * 7/2004 McKinney ..... A47L 23/205 34/104
7,430,816 B1 * 10/2008 Lozenski ..... A47L 23/205 34/104
9,038,817 B2 * 5/2015 Connolly ..... B65B 5/08 206/3
9,637,294 B2 * 5/2017 Kinskey ..... B65D 81/02
10,151,059 B1 * 12/2018 Tsai ..... D06F 57/08
2015/0107131 A1 * 4/2015 Barnes ..... F26B 9/003 34/487
2016/0101443 A1 * 4/2016 Christensen ..... B07B 1/22 134/95.2

(Continued)

FOREIGN PATENT DOCUMENTS

JP 06109398 A * 4/1994
JP 07136560 A * 5/1995 ..... B05B 1/005
KR 101147699 B1 * 5/2012

*Primary Examiner* — Stephen M Gravini
(74) *Attorney, Agent, or Firm* — Christopher R. Ganter, LLC

(57) ABSTRACT

The invention disclosed is an ammunition cartridge case dryer for use in the cleaning, drying and reloading of ammunition cartridge cases. It comprises an upper housing, a base, means for forcing air into a hollow space defined by the upper housing and base, an array of cups or nozzles that are located on the upper surface of the dryer and are adapted to receive a wet cartridge case. The nozzles have apertures in communication with the hollow space such that air can be expelled through said nozzles into said cases for quick drying.

26 Claims, 9 Drawing Sheets

(56) References Cited

U.S. PATENT DOCUMENTS

2016/0118186 A1* 4/2016 Frimpong ..... G01H 1/00
307/119
2017/0370646 A1* 12/2017 Rettig ..... F26B 21/004

* cited by examiner

AMMUNITION CARTRIDGE CASE DRYER

CROSS-REFERENCED TO RELATED APPLICATIONS

None

FEDERALLY SPONSORED RESEARCH

None

SEQUENCE LISTING

None

FIELD OF THE INVENTION

The invention relates to a dryer for ammunition cartridge cases that is capable of quickly drying ammunition cartridges by use of an array of apertures or nozzles that have heated air directed through them and into the interior of an ammunition cartridge case.

BACKGROUND OF THE INVENTION

The practice of hand-loading or reloading is the process of loading firearm ammunition cartridges or shotgun shells by assembling the individual components (case/hull, primer, powder, and bullet/shot), rather than purchasing completely assembled, factory-loaded ammunition. Many gun owners load their own ammunition instead of buying manufactured ammunition for a variety of reasons such as cost savings and consistent performance and reliability. As the term reloading suggests, a cartridge case can be reused more than one time, and often times it can be reused many times depending on how powerful a load is used. A piece of ammunition consists of a case, a primer which is an explosive device that fits into the back of the cartridge case, powder inserted into a cartridge case and a bullet inserted into the front of the cartridge case. After a unit of ammunition is fired, reloaders will save their cartridge cases (aka "brass" because cartridge cases are generally made of brass) to reload again.

The explosion of gunpowder inside of the cartridge case leaves a dirty and fouled residue and must be cleaned out before reloading again. Machines called ultrasonic case cleaners are used to perform this cleaning function. These ultrasonic case cleaners use water and specially formulated solutions to aid in the cleaning of the cartridge cases. After the cartridge cases are clean, there is residual water and cleaning agent left in the case. The cartridge case must be absolutely dry before introducing a gun powder or propellant into the cartridge case and the inability to have a dry cartridge case will lead to faulty and unpredictable loaded ammunition. Because of the encapsulated nature of the cartridge cases, it can take an undesirable length of time to dry the case out. There exists a case dryer in the prior art that has been modelled after a food dehydrator but it is highly inefficient and takes an extended time to fully dry the cases. One particular reason this case dryer is not efficient is that it does not allow for vertical placement and drainage of water out of the case. A further reason why the prior art dryer is ineffective is that it does not allow a sufficient amount of air to be directly introduced inside the case. What is needed in the art is a cartridge case dryer that allows for rapid drying of the case.

SUMMARY OF THE INVENTION

The present invention is an ammunition cartridge case dryer designed to allow for rapid drying of wet cartridge cases. The dryer has a housing that attaches to a base creating a hollow space in between the housing and the base. The housing has apertures on its upper surface and said apertures are located in the middle of either depressed cups or nozzles formed in the housing for the purpose of placing a wet ammunition cartridge case thereon in a vertical position. The base has connection tabs suited to be received by slots located on the side walls of the housing. Located and installed on the base is a motorized fan and a heating element for the purpose of blowing air into the hollow space and out of the apertures and into the ammunition cartridge cases. Also located on the base is a baffle to prevent overheating of the motorized fan and to direct the air into the hollow space and out of the apertures.

Specific advantages and features of the present assembly will be apparent from the accompanying drawings and the description of several illustrative embodiments of the present invention.

It should be understood that the present drawings are not necessarily to scale and that the embodiments disclosed herein are sometimes illustrated by fragmentary views. In certain instances, details which are not necessary for an understanding of the present invention or which render other details difficult to perceive may have been omitted. It should also be understood that the invention is not necessarily limited to the particular embodiments illustrated herein. Like numbers utilized though-out the various figures designate like or similar parts or structure.

DETAILED DESCRIPTION

The invention is generally depicted in FIGS. 1-11 but may be embodied in various other forms. The principles and teachings of the invention, therefore, can be applied to numerous alternative variations.

Figure 1:
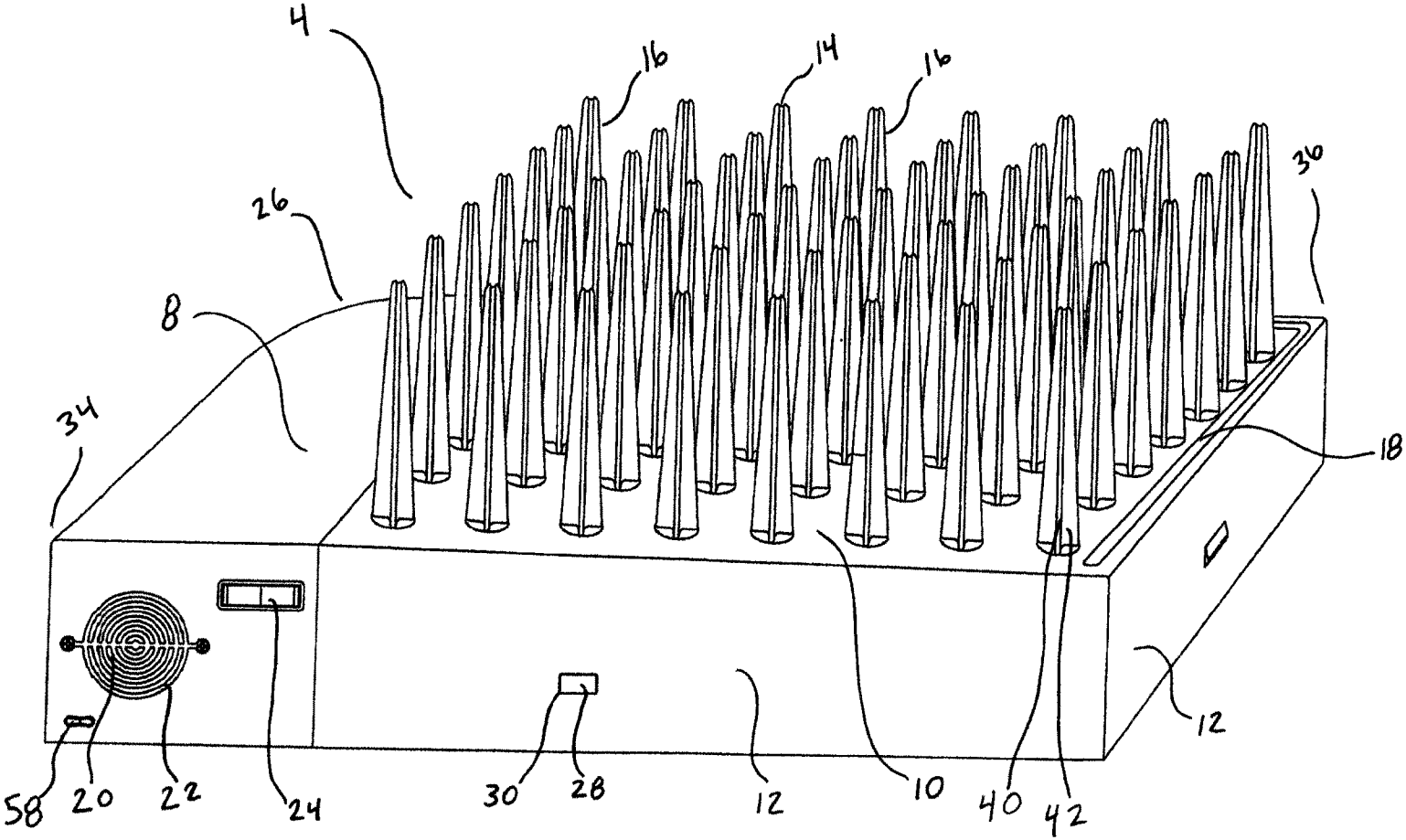
FIG. 1 is a perspective view of the ammunition cartridge case dryer.
Figure 4:
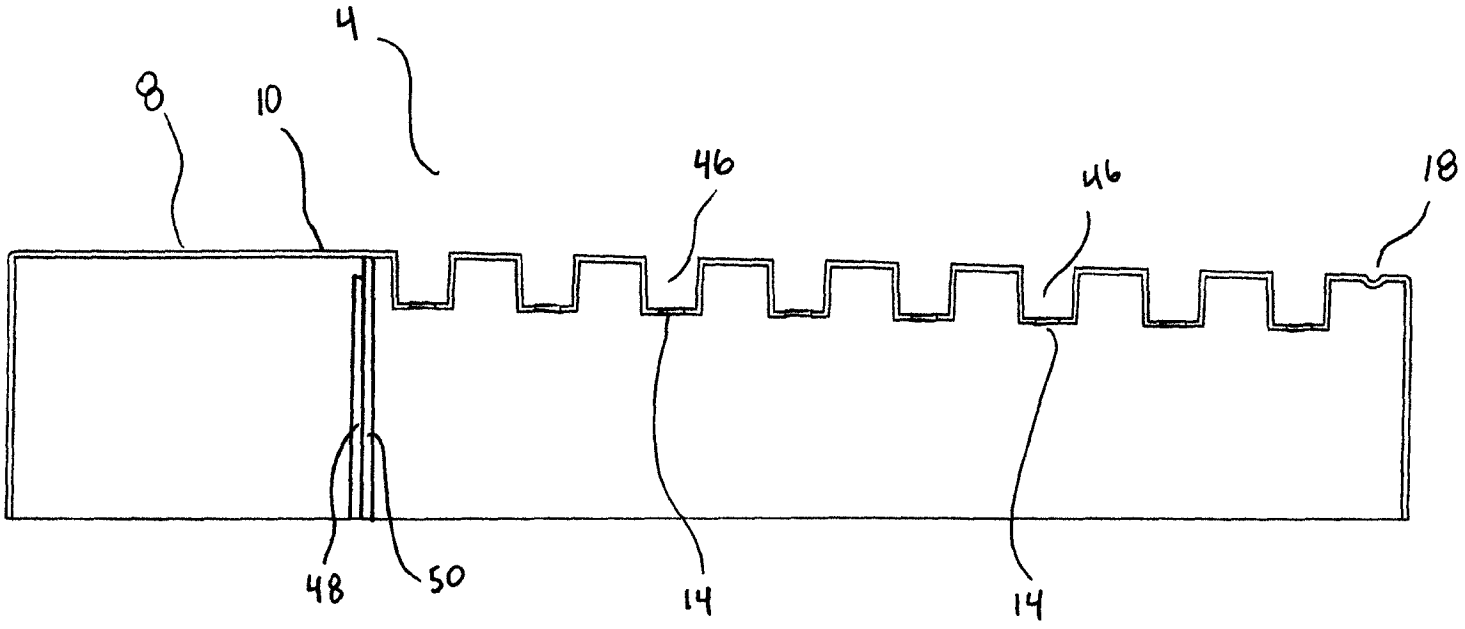
FIG. 4 is a cross sectional view of the ammunition case dryer along the plane A-A as shown in FIG. 2.

Referring now to FIG. 1, there is shown the ammunition cartridge case dryer 4 having a housing 8. The housing 8 has an upper surface 10 and four side walls 12 that are oriented in a rectangular or trapezoidal shape. Located on the upper surface 10 are nozzles 16 that have apertures 14 located at their top end. The nozzles 16 can be tapered and/or conical in shape to allow placement of a variety of different sized cartridge cases. The nozzles can also be shaped such that they have a vertical post component and an aperture running through said nozzle 16 and communicating with the hollow space 44, as shown in FIG. 4, with the outside atmosphere. The nozzles 16 can also simply be formed as a post of nearly any cross-sectional shape that will allow a cartridge case to be installed thereon and to be able to have an aperture 14 running through its center and length. As shown, the nozzles 16 are fluted such that they have ridges 40 and grooves 42 to allow water to drain out of the cartridge case. This design allows for the drainage of water and also the reduction of material it takes to form the nozzles 16 as opposed to a purely cone shaped nozzle 16, although a cone shaped nozzle 16 would to some extent feasible. The nozzles 16 can have at the very least two ridges 40 and grooves 42 such that the ridges 40 are opposite each and 180 degrees in relation to one another. Another advantage of having grooves 42 along the nozzles 16 length is the scenario that arises when a spent primer has not been removed from an ammunition cartridge case. The primer is located at the end of the cartridge case, and when it is removed, it allows for the exit of air when the case is placed upon a nozzle 16. However, if the primer has not been removed, air cannot exit the cartridge case if it is placed on top of a circular conical nozzle 16 because the mouth of the case seals fairly tightly with a circular conical nozzle 16. In this situation, the use of fluted nozzles 16 with ridges 40 and grooves 42 proves further advantageous.

The nozzles 16 can be formed into the housing 8 such that the housing 8 and nozzles 16 are a unitary piece. Alternately and as further shown in FIG. 4, the nozzles 16 can be manufactured separately and can be inserted into depressed cups 46 that are formed into the housing 8. This approach allows for easier manufacture of the dryer 4 housing 8. The nozzles 16 or depressed cups 46 are positioned in an array for ease of counting cartridge cases and to make the most of available space on the upper surface 10 of the housing 8.

Figure 8:
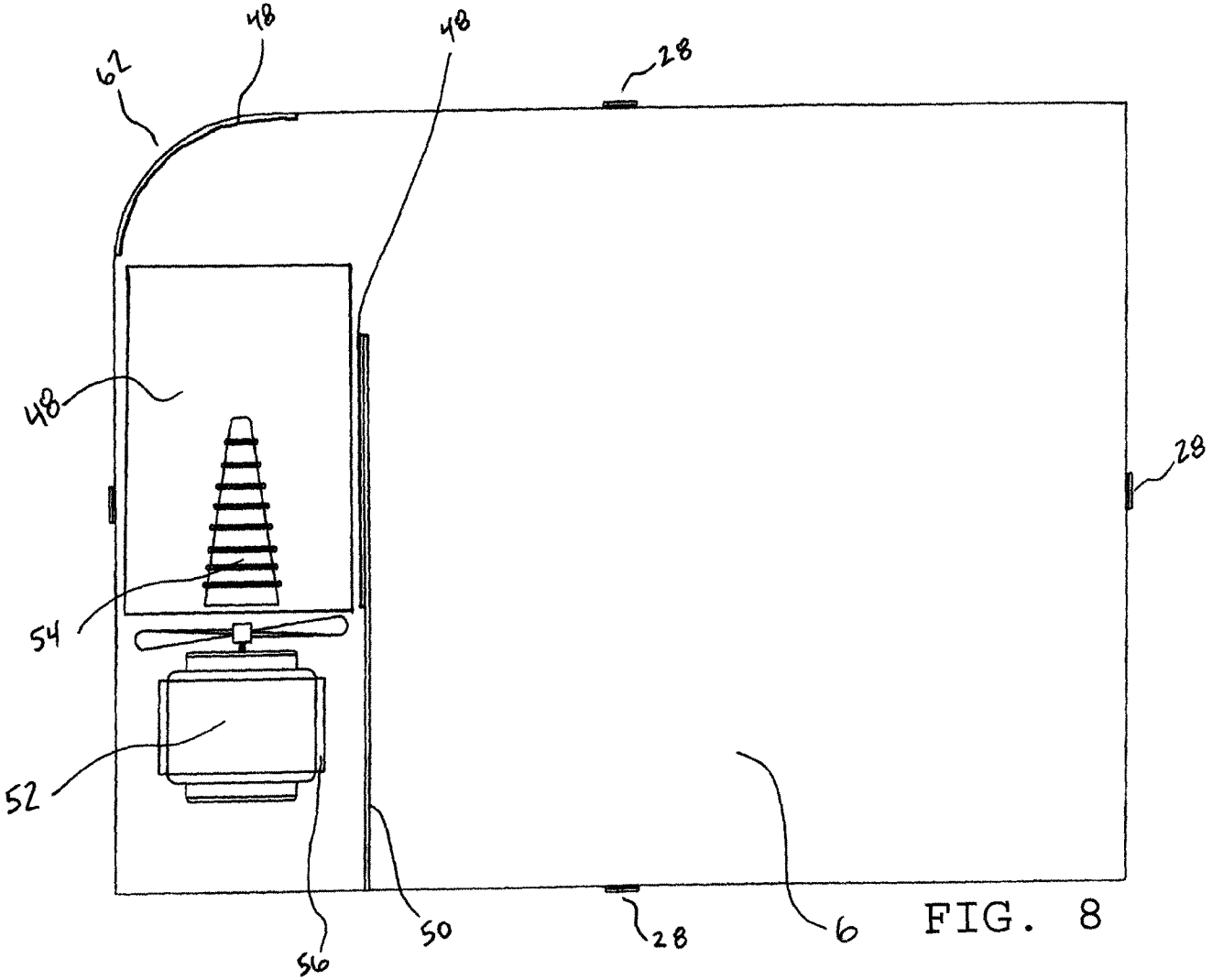
FIG. 8 is a top plan view of the base of the ammunition cartridge case dryer.

The dryer 4 housing 8 has a curved corner 26 positioned such that it aids in directing airflow around a baffle 50 as shown in FIG. 8 below. The dryer 4 housing 8 is formed so that any water that exits any drying cartridge case that is resting on the nozzles 16 will drain in a focused and concentrated direction. This is achieved by forming the housing 8 sidewalls 12 such that they are slightly trapezoidal in shape such that an elevated corner 34 of the housing 8 is at a higher elevation than that of a depressed corner 36. This causes the upper surface 10 to have a gently sloping character such that it will aid in the directional drainage of water. Further aiding this drainage system are two depressed channels 18 that are located on the upper surface 10 of the housing 8. The channels 18 are located along edge of the upper surface 10 and along and in close proximity to the adjacent sidewalls 12. The channels 18 meet at a perpendicular junction with respect to each other at the depressed corner 36. The channels 18 are formed into the upper surface 10 of the housing 8.

Also shown in FIG. 1 are connection tabs 28 that lock into receiving slots 30 on the sidewalls 12 of the housing 8 for connection to the base 6. There is also shown an inlet vent 20 with an inlet vent guard 22 installed thereon. The inlet vent 20 allows air to be pulled into the dryer 4 such that it can be heated and moved on through the apertures 14 and out of the nozzles 16 and into the a cartridge case for drying. Also shown is a power switch 24 and a power source opening 58 for an electrical wire. The dryer 4 will make use of direct current electric power by employing a transformer plug though it could run off of alternating current and a step down transformer would be located in the housing 8. The power switch 24 can have more than one on position such that it allows for varying airflow speed and heated or ambient air to enter the dryer 4. The housing 8 is made of plastic and formed by way of injection molding or other similar processes. The housing 8 could be made of metal but it would not be as economically effective as that of plastic. The nozzles 16 in one embodiment are formed separately from the housing 8 and they too can be formed by way of injection molding.

Figure 2:
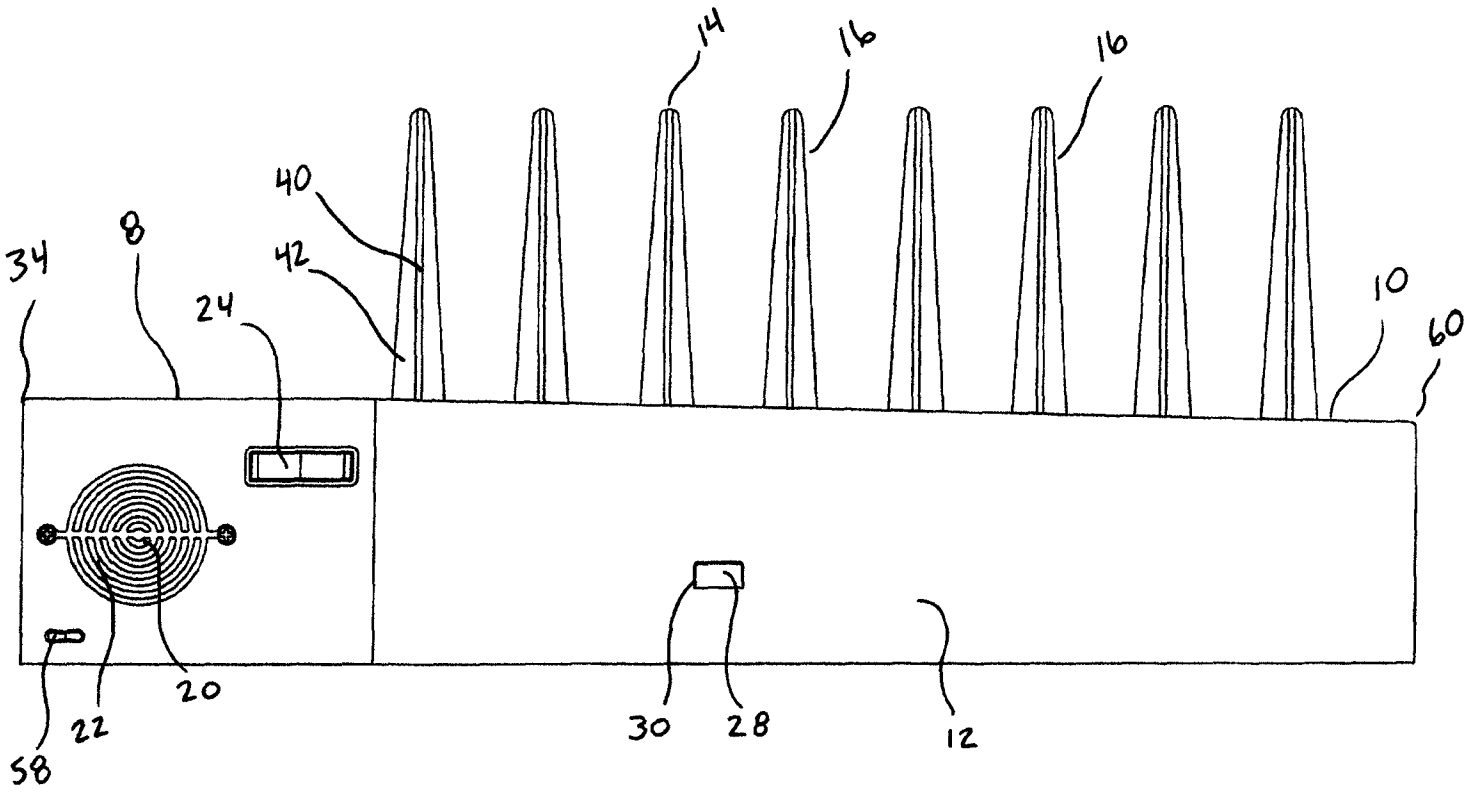
FIG. 2 is a top plan view of the ammunition cartridge case dryer.

Referring now to FIG. 2 there is shown the housing 8 upper surface 10 with nozzles 16 having apertures 14 at their center and having ridges 40 and grooves 42. There is also shown the intersecting depressed channels 18 formed into the surface of the housing 8 upper surface 10. The curved corner 26 is formed into the housing 8 to promote airflow into the hollow space 44 as shown in FIG. 4. The nozzles 16 are arranged in an array pattern and in combination with the elevated corner 34, the channels 18 and the depressed corner 36 promote drainage of water to the depressed corner 36 region. The array configuration of the nozzles 16 allows for easy determination of the number of cases that will be dried at a given period. There is also shown the power switch 24 and the inlet vent guard 22.

Figure 3:
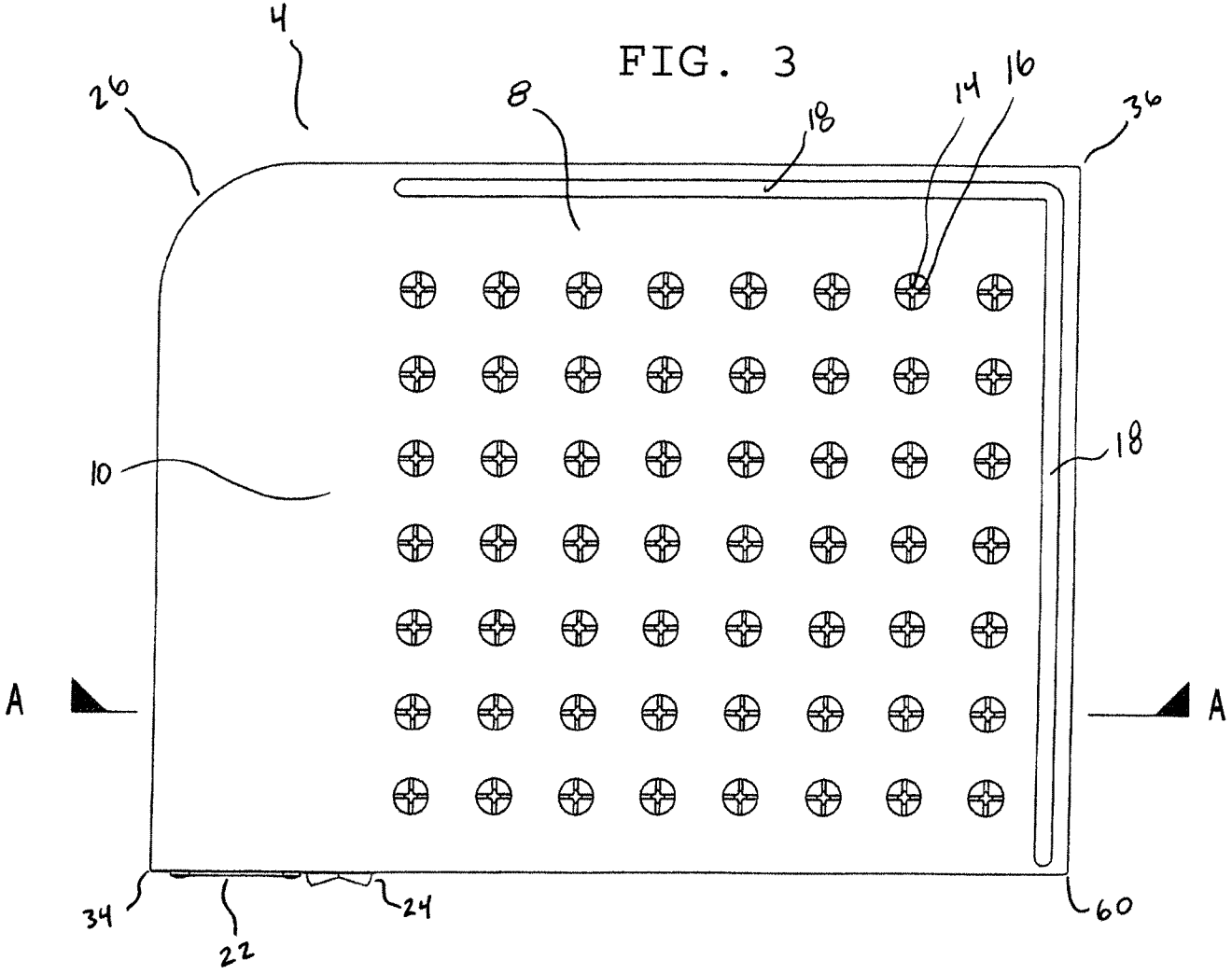
FIG. 3 is side plan view of the cartridge case dryer.

Referring now to FIG. 3 there is shown the housing 8 and sidewall 12 wherein the sidewall 12 is slightly trapezoidal in shape. This trapezoidal shape aids in the slightly angled upper surface 10 of the housing 8 and causes intermediate corner 60 to be slightly lower in elevation than the elevated corner 34 but higher in elevation than the depressed corner 36. This cause the gradient of flow across the upper surface 10 of the housing 8 to flow in the direction of a vector drawn in the direction from the elevated corner 34 to the depressed corner 36. Also shown in FIG. 3 is a side profile of the nozzles 16 with their ridges 40 and grooves 42. The sidewall 12 shows the connection tab 28 installed into the receiving slot 30. There is also shown the inlet vent 20, the inlet vent guard 22, power switch 24 and the power source opening 58 wherein an electric cord will be installed.

Referring now to FIG. 4 there is cross-sectional view along the plane A-A as shown in FIG. 2 showing the interior of the housing 8 and an alternate embodiment of the dryer 4 housing 8. There is shown depressed cups 46 with apertures 14 located centrally inside and on the bottom of said depressed cups 46. The depressed cups 46 can serve two purposes. One purpose is to independently receive a wet cartridge case by inserting the cartridge case neck first into the depressed cup 46. The aperture 14 located in the depressed cup 46 will be positioned directly underneath the opening of the cartridge case and will blow air into the cartridge case to dry it. The width of the depressed cups 46 allows for placement of a wide variety of sizes of cartridge cases. In one embodiment the depressed cups 46 have a top diameter and a bottom diameter. The top diameter can be around 0.53 inches and the lower diameter can be 0.5 inches. This change in diameter causes the cups 46 to be frustoconical in shape such that the sidewalls of the cups 46 have a slight angle. Numerous variations in diameter measurements could be used, but the above identified diameters accommodate a large majority of the ammunition cartridge cases in use today. For smaller cartridge cases, the entire cartridge case including the neck, shoulders and sidewall of the case will fit into the depressed cups 46. For those cases that are larger, the depressed cups 46 will accommodate a cartridge case such that the neck is inserted into the depressed cup 46 and the cartridge shoulder will rest on the upper surface 10 of the housing 8. The liquid inside a cartridge case will evaporate and/or drip into the bottom of the depressed cup 46 where it will further evaporate or drain into the hollow space 44 where it will complete the process of evaporation.

A second use for the depressed cups 46 is to receive a nozzle 16 that can be formed and manufactured independently of the housing 8. To achieve this result the depressed cups 46 are slightly inverted or frustoconical in shape such that the top of the depressed cup 46 has a slightly wider diameter than the bottom of the depressed cup 46. The depressed cup 46 will then receive a nozzle 16 as shown in FIG. 5 that has a base 38 that is frustoconical in shape such that it conforms to the depressed cup 46 shape and securely nests into the depressed cup 46 by using the frictional properties of the plastic of which the depressed cups 46 and the nozzles 16 are formed.

Figure 9:
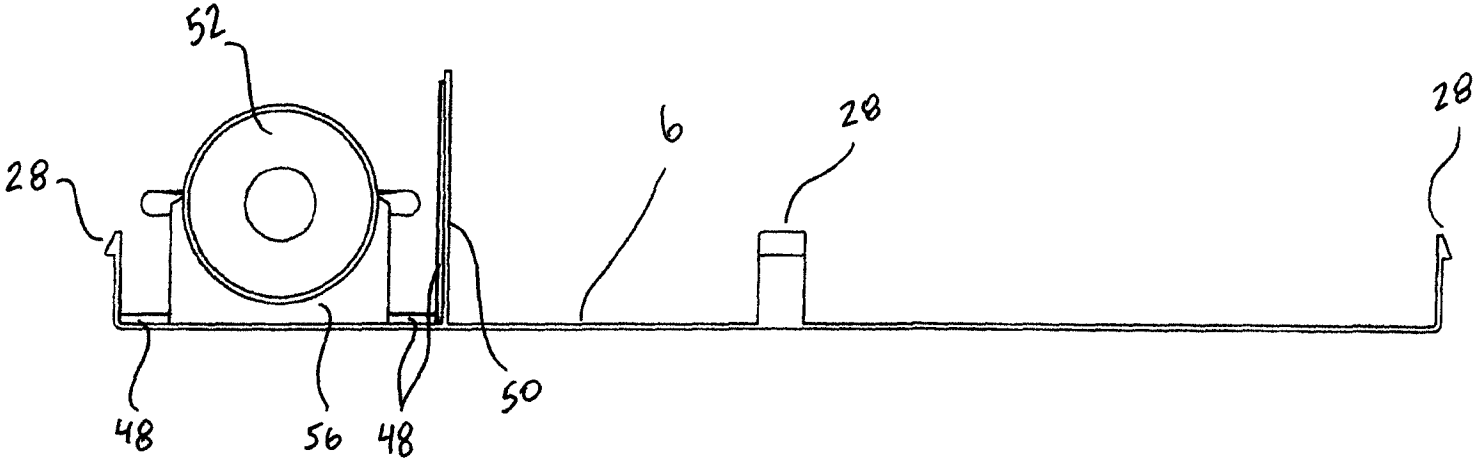
FIG. 9 is a side plan view of the base of the ammunition cartridge case dryer.

Also shown in FIG. 4 is the hollow space 44 that is formed between the housing 8 and the base 6. Additionally a baffle 50 is located in the hollow space 44 such that it separates the area directly underneath the depressed cups 46 from that area where a motorized fan 52 and heating element 54 are located, as shown in FIGS. 8-9, such that the heated air generated by the heating element 54 will not damage or overheat the motorized fan 52. The baffle 50 ensures that the motorized fan 52 circulates air that comes from outside of the housing 8. Heat shields 48 will be installed upon the side of the baffle 50 closest to the motorized fan 52 and the heating element and 54. Also shown in FIG. 4 is a channel 18 formed into the upper surface 10 of the housing 8 for the drainage of water.

Figure 6:
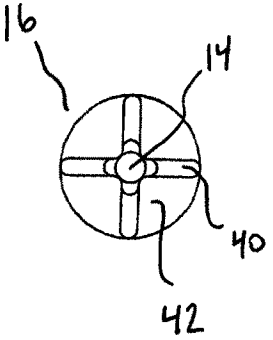
FIG. 6 is a top plan view of an insertable nozzle.
Figure 7:
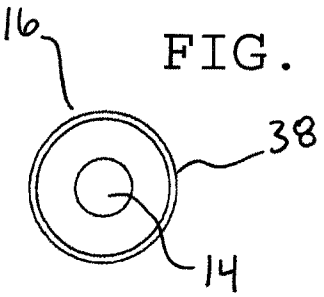
FIG. 7 is a bottom plan view of an insertable nozzle.
Figure 5:
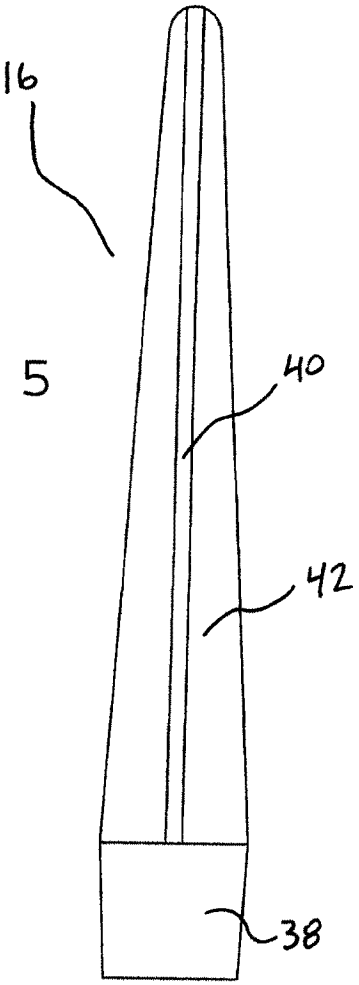
FIG. 5 is a side plan view of an insertable nozzle.

Referring now to FIGS. 5, 6 and 7 are shown views of the nozzle 16 having a base portion 38 and ridges 40 and grooves 42 and aperture 14 passing through the nozzle 16. This aperture 14 aligns with the aperture 14 located in the depressed cup 46 as shown in FIG. 4 such that air is permitted to escape the aperture 14 on the top of the nozzle 16. The base portion 38 is frustoconical in shape so that it allows easy installation into the depressed cups 46. In an embodiment where the nozzles 16 are formed into the housing 8 instead of being formed separately, the aperture 14 communicates with the hollow space 44 as shown in FIG. 4 so as to permit air to blow out of the aperture 14 of the nozzle 16 top portion. The aperture 14 runs through the center of the nozzle 16 and through its length.

Referring now to FIG. 8, there is shown a top plan view of the base 6 with installed motorized fan 52 and heating element 54 and baffle 50 whereby the baffle 50 separates the motorized fan 52 and the heating element 54 from the hollow space 44 where the depressed cups 46 or nozzles 16 are located. The baffle 50 is formed as part of the base 6. The baffle 50 is essential to keep the hot air circulating and separate from the motorized fan 52 so that the motorized fan 52 does not overheat and burn up. The base 6 can be made of metal and/or plastic. If the base 6 or housing 8 is made of plastic, heat shields 48 made out of either metal, ceramic, textile or fibrous material need to be used to protect the base 6 and housing 8 in the location of the heating element 54. The base 6 has a curved corner 62 such that it conforms with the housing 8 curved corner 26. The curved corner 26 of the housing 8 helps to aid in funneling the air forced by the motorized fan 52 around the baffle 50 and into the hollow space 44 underneath the depressed cups 46 and/or nozzles 16. Also shown on the base 6 are connection tabs 28. The motorized fan 52 is the means for forcing air into the hollow space 44 such that it exits through said apertures 14. Alternately, a centrifugal fan could be used as the air forcing means.

Referring now to FIG. 9, there is shown a side plan view of the base having the motorized fan 52 installed onto the base 6 and the baffle 50. Also shown are connection tabs 28. The mounting motorized fan 52 is mounted into the base 6 by way of a motor mount 56 formed into the base 6. The baffle 50 and the motor mount 56 are formed into the base by means of injection molding and in a preferred embodiment could be made of a variety of different plastic materials. The motor mount 56 mounts holds the motorized fan 52 in fixed position by having a corresponding circular shape on the motor mount 56 upper surface. The motor mount 56 shape is a circular arc slightly greater than 180 degrees such that the upper edges of the motor mount 56 surround the motorized fan 52 to a point where they can exert an opposing force from above. The motorized fan 52 can be installed by pushing the motorized fan 52 into the motor mount 56 from above and due to the nature of plastic to slightly bend the motorized fan 52 can be locked into place in the motor mount 56. Additionally, the motorized fan 52 can be installed from the side into the motor mount 56. An adhesive can be used to secure the motorized fan 52 to the motor mount 56 after installation. The power switch 24, as shown in FIG. 1, is connected by electrical wire to a power source which is then connected to the motorized fan 52 and the heating element 54. The power switch can be a selector switch that allows for alternate motorized fan 52 speed and heating element 54 output.

Figure 10:
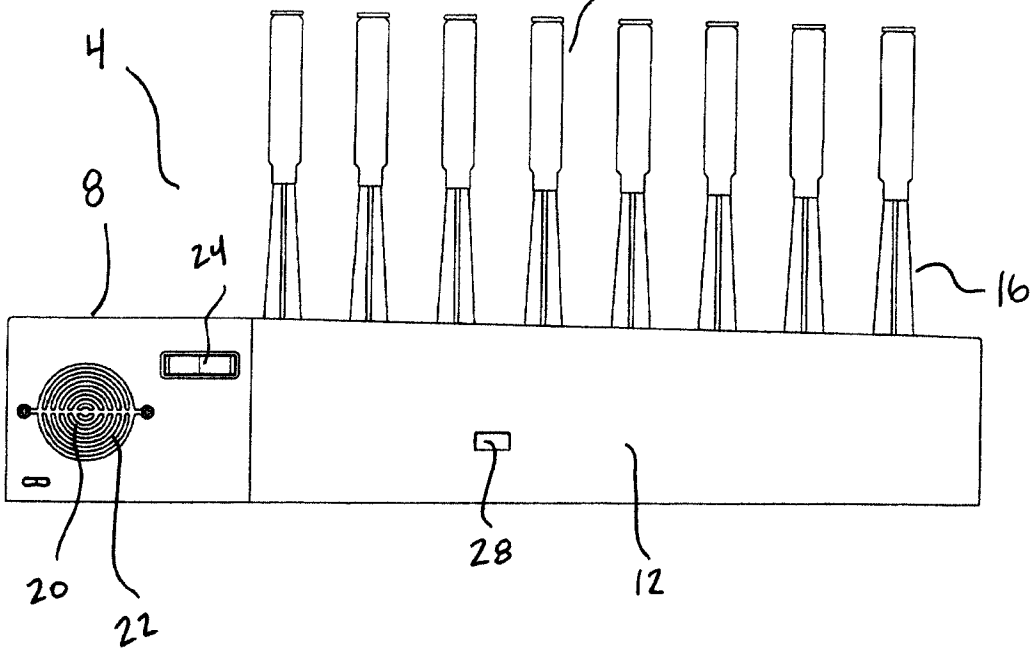
FIG. 10 is a side elevation view of the ammunition cartridge case dryer shown with cartridge cases installed on the nozzles.

Referring now to FIG. 10, there is shown the dryer 4 with cartridge cases 32 installed thereon. As can be observed the nozzles 16 would accommodate a number of different cartridge case 32 sizes due to their tapering nature.

Figure 11:
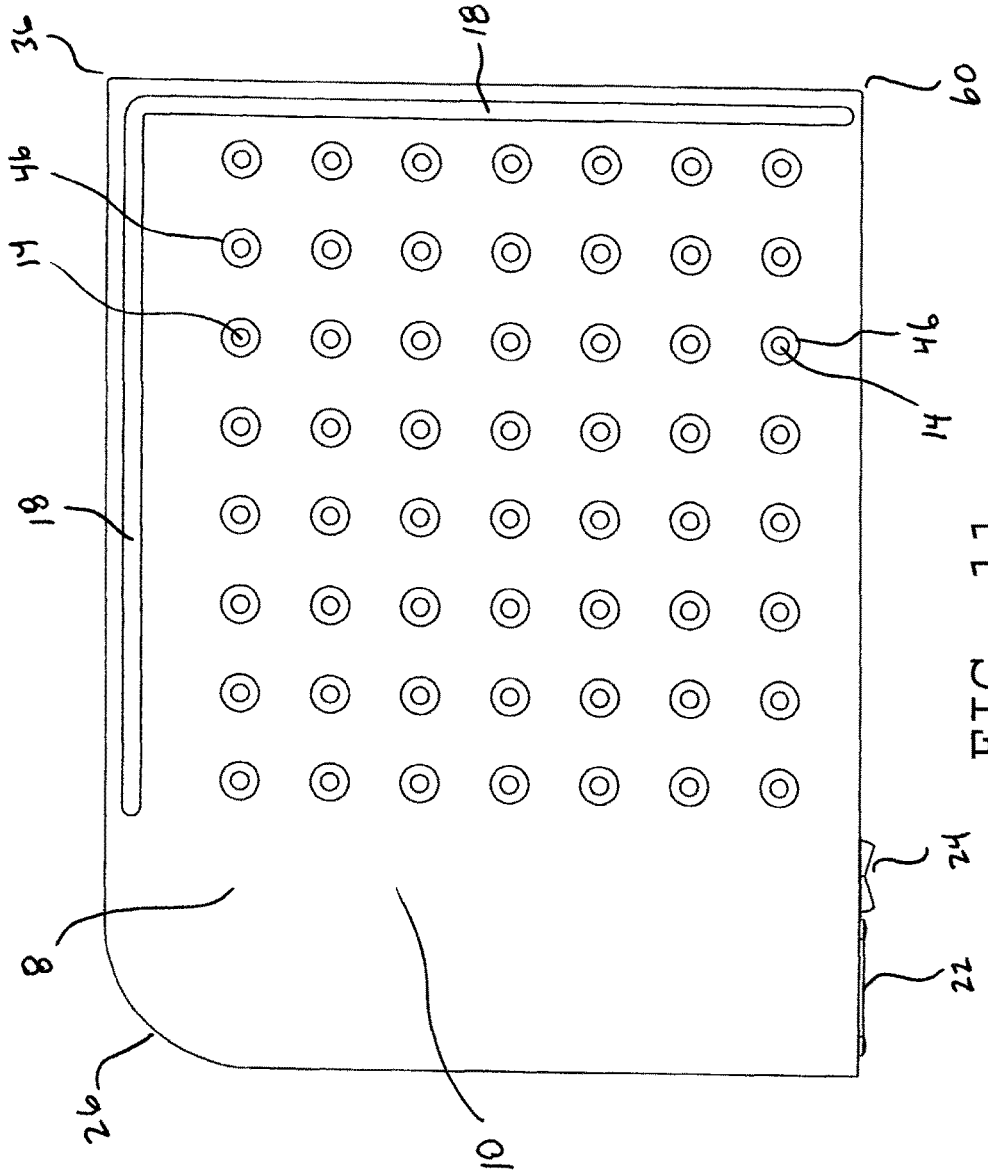
FIG. 11 is a top plan view of the ammunition cartridge case dryer shown with depressed cups formed in the housing.

Referring now to FIG. 11, there is shown a top plan view of the dryer 4 and an alternate embodiment of the invention with the depressed cups 46 having apertures 14. As stated above, the depressed cups 46 can be used on their own to dry a cartridge case 32 or they can be used to install removable nozzles 16 at a user's discretion.

The principles, embodiments, and modes of operation of the present invention have been set forth in the foregoing specification. The embodiments disclosed herein should be interpreted as illustrating the present invention and not as restricting it. The foregoing disclosure is not intended to limit the range of equivalent structure available to a person of ordinary skill in the art in any way, but rather to expand the range of equivalent structures in ways not previously contemplated. Numerous variations and changes can be made to the foregoing illustrative embodiments without departing from the scope and spirit of the present invention.

What is claimed is:

1. An ammunition cartridge case dryer, comprising:

a housing having a plurality of apertures formed in its a top surface of the housing whereby said apertures are adapted to receive and support an ammunition cartridge case;

a base connectable to said housing such that a hollow space is formed in between the housing and the base;

a motorized fan connected to a power source that forces air into the hollow space such that said air exits through said apertures and into the adjacent ammunition cartridge case.

2. The ammunition cartridge dryer of claim 1 wherein there is an array of depressed cups formed into a top surface of said housing and said apertures are arranged in an array and are located the depressed cups.

3. The ammunition cartridge dryer of claim 2 further comprising nozzles insertable into said depressed cups wherein said nozzles have a base and an ammunition cartridge case engaging portion.

4. The ammunition cartridge dryer of claim 3 wherein the nozzles have a base that is conformed to the depressed cups for secure installation.

5. The ammunition cartridge dryer of claim 3 wherein the nozzles are formed such that the nozzles protrude above the housing, said nozzles having an aperture passing through the nozzles length and terminating at a top end of the nozzles and in fluid communication with said aperture in the depressed cups located in the housing, and said nozzles are adapted to receive an ammunition cartridge case.

6. The ammunition cartridge case dryer of claim 3 wherein said nozzles are tapered along their length such that an upper end of each of said nozzle is narrower in width than a lower end of the nozzle.

7. The ammunition cartridge case dryer of claim 3 wherein said nozzles are fluted such that said nozzles have ridges and grooves running along each of said nozzles length.

8. The ammunition cartridge case dryer of claim 3 further comprising channels located on an edge of the housing that intersect at a depressed region of the housing.

9. The ammunition cartridge case dryer of claim 3 wherein a corner of the housing has a curved orientation and further comprising a baffle located in said hollow space.

10. The ammunition cartridge case dryer of claim 2 wherein a corner of the housing has a curved orientation and further comprising a baffle located in said hollow space.

11. The ammunition cartridge case dryer of claim 1 further comprising a baffle and a corner of the housing has a curved orientation.

12. An ammunition cartridge case dryer, comprising:

A housing having a plurality of nozzles formed on a housing top surface in an array whereby said nozzles are adapted to receive a variety of different sized ammunition cartridge cases and each of said nozzles have an aperture running through the length of the nozzle whereby said aperture allows for air to be introduced into an ammunition cartridge case;

A base connectable to said housing such that a hollow space is formed in between the housing and the base and said nozzle apertures are in fluid communication with the hollow space; and a motorized fan connected to a power source whereby said fan forces air into the hollow space such that air is forced through said apertures located in the nozzles and whereby said air exits the hollow space through each of the nozzles and into the ammunition cartridge case.

13. The ammunition cartridge case dryer of claim 12 wherein nozzles are formed into the housing such that they protrude out of and above the housing, said apertures passing through each of the nozzles length, and said nozzles are adapted to receive an ammunition cartridge case.

14. The ammunition cartridge case dryer of claim 12 wherein said nozzles are tapered along said nozzles length such that an upper end of each nozzle is narrower than a lower end of each nozzle.

15. The ammunition cartridge case dryer of claim 12 wherein said nozzles are fluted such that said nozzles have ridges and grooves running along a nozzle length.

16. The ammunition cartridge case dryer of claim 12 further comprising channels located on an edge of the housing that intersect at a depressed region of the housing.

17. The ammunition cartridge case dryer of claim 12 wherein a corner of the housing has a curved orientation and further comprising a baffle located in said hollow space.

18. An ammunition cartridge case dryer, comprising:

A housing comprising a plurality of apertures formed in said housing top surface adapted to receive a variety of ammunition cartridge case;

A base connectable to said housing such that a hollow space is formed in between the housing and the base;

a power supply;

a motorized fan;

a heating element;

a step down transformer; a power selector switch;

an inlet vent; and an inlet vent guard.

19. The ammunition cartridge case dryer of claim 18 wherein there is an array of depressed cups formed into a top surface of said housing and the apertures are arranged in an array and are located in the array of depressed cups formed into the housing.

20. The ammunition cartridge case dryer of claim 19 further comprising nozzles insertable into said depressed cups.

21. The ammunition cartridge case dryer of claim 20 wherein the nozzles have a base that is conformed to said depressed cups for secure installation.

22. The ammunition cartridge case dryer of claim 21 wherein the nozzles are formed such that they protrude above the housing, said nozzles having an aperture passing through said nozzle length and terminating at a top end of the nozzles and in fluid communication with said aperture in the depressed cups located in the housing, and said nozzles are adapted to receive an ammunition cartridge case.

23. The ammunition cartridge case dryer of claim 22 wherein said nozzles are tapered along each said nozzles length such that the top end of the nozzle is narrower in width than a lower end of the nozzles.

24. The ammunition cartridge case dryer of claim 23 wherein said nozzles are fluted such that said nozzles have ridges and grooves running along a nozzle length.

25. The ammunition cartridge case dryer of claim 24 wherein a corner of the housing has a curved orientation and further comprising a baffle located in said hollow space.

26. The ammunition cartridge case dryer of claim 18 wherein a corner of the housing has a curved orientation and further comprising a baffle located in said hollow space.

* * * * *